United States Patent [19]

McGourty

[11] 4,053,040

[45] Oct. 11, 1977

[54] SERIAL WIRE MATRIX PRINTER

[76] Inventor: Thomas K. McGourty, 1640 Cox Road, Aptos, Calif. 95003

[21] Appl. No.: 623,967

[22] Filed: Oct. 20, 1975

[51] Int. Cl.[2] ..... B41J 1/24

[52] U.S. Cl. ..... 197/1 R; 197/82; 197/151; 197/168; 74/89.15

[58] Field of Search ..... 197/1 R, 16, 49, 56–58, 197/82; 178/23 R, 33, 34; 101/93.37, 93.44, 93.04, 93.05; 74/20, 25, 26, 27, 53, 55, 57, 89.15, 99 R

[56] References Cited

U.S. PATENT DOCUMENTS

| | | | |
|---|---|---|---|
| 2,911,085 | 11/1959 | Leathers | 197/1 R |
| 3,128,696 | 4/1964 | Hoffman | 197/56 X |
| 3,387,081 | 6/1968 | Kleinschmidt et al. | 101/93.04 X |
| 3,572,238 | 3/1971 | Andersen | 197/1 R X |
| 3,583,245 | 6/1971 | Schaefer | 74/57 |
| 3,592,311 | 7/1971 | Chou et al. | 101/93.05 X |
| 3,623,574 | 11/1971 | Gardner | 74/89.15 X |
| 3,762,227 | 10/1973 | Bohnhoff | 74/89.15 |
| 3,854,563 | 12/1974 | Cowardin et al. | 197/1 R |
| 3,949,851 | 4/1976 | Phelan | 197/1 R |

OTHER PUBLICATIONS

Wolfheimer, "Selective Indicia Printer", IBM Tech. Discl. Bull., vol. 17, No. 6, Nov. 1974, p. 1705.

*Primary Examiner*—Ralph T. Rader
*Attorney, Agent, or Firm*—Fred N. Schwend

[57] ABSTRACT

Guide means for a serially operable wire matrix printer head wherein a guide is provided for linearly and pivotally guiding the printing end of the head adjacent and parallel to the plane of the paper. Independent means are provided to pivotally support the opposite and heavier end of the head and for permitting movement of such end in a direction substantially at right angles to the plane of the paper.

8 Claims, 10 Drawing Figures

SERIAL WIRE MATRIX PRINTER

BACKGROUND OF THE INVENTION 1. Field of the Invention

This invention relates to printers and has particular reference to printers of the dot matrix type embodying wire or like printing elements. 2. Description of the Prior Art High speed wire matrix printers having a printer head movable along the plane of the paper for serially printing characters have been in extensive use heretofore. Such printer heads generally comprise a plurality of vertically aligned print wires operable endwise by solenoids or similar actuators.

Although such printers are generally satisfactory, they have been expensive to manufacture and have been limited in speed due to inertia and momentum of certain moving parts, particularly the printer head, since the latter must bodily transport the relatively heavy solenoids or other wire actuators across the plane of the paper.

SUMMARY OF THE INVENTION

A principal object of the present invention is to provide a high speed serially operable wire printer.

Another object is to reduce the inertia and momentum forces of the moving parts of a printer of the above type.

Another object is to provide a simple and inexpensive yet highly reliable serially operable wire printer.

The printer of the present invention, in its broader aspects, comprises a linear guide means extending adjacent and parallel to the plane of the paper at the print line and having pivotal means movable therealong for guiding the rear or printing end of a wire print head. The opposite and heavier end of the print head is pivotally supported and is permitted movement toward and away from the plane of the paper. Accordingly, the heavier end of the head is located adjacent the forward pivotal support and therefore is subject to less inertia and momentum forces than the relatively light rear end which is transported along the printing line. This construction also reduces any binding tendencies which occur in printers of the type wherein the print head is mounted for sliding movement along two or more shafts.

A further feature of this construction is that the flexible electrical conductors for energizing the solenoids need flex through a shorter distance of travel than would be the case if the head were bodily transported between the extremes of its travel.

The manner in which the above and other objects of the invention are accomplished will be readily understood on reference to the following specification when read in conjunction with the accompanying drawings.

DESCRIPTION OF THE PREFERRED EMBODIMENT

Figure 1:
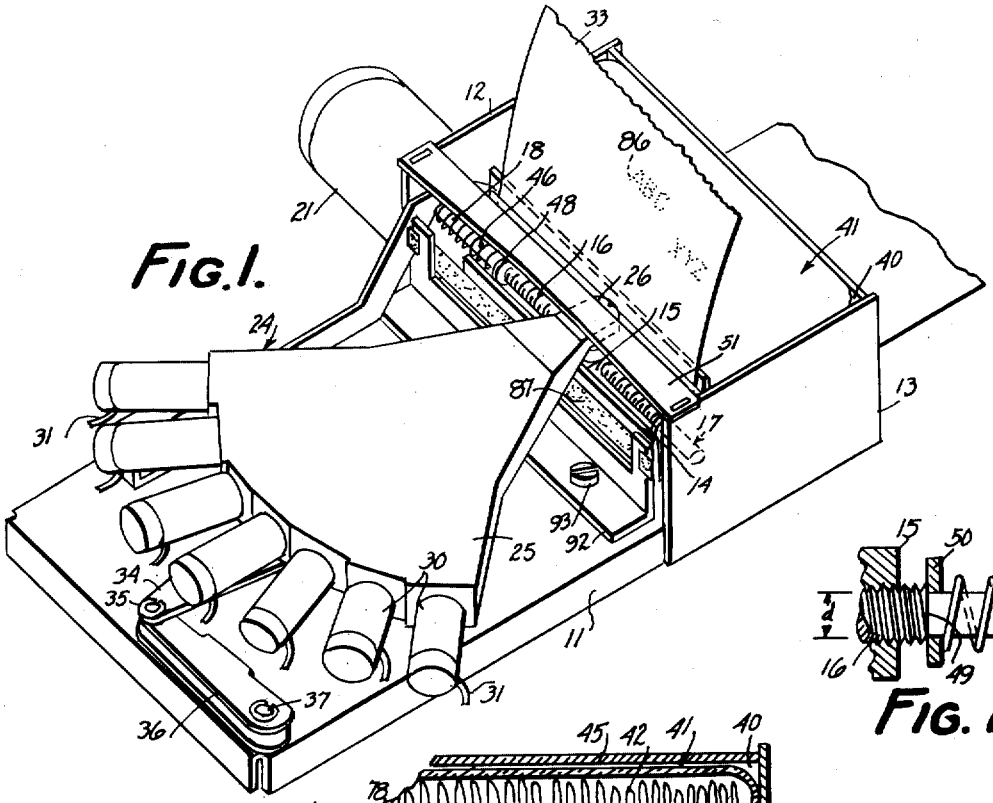
FIG. 1 is a perspective view of a wire printer embodying a preferred form of the present invention.

Referring to the drawings, the printer comprises a base 11 having spaced side frames 12 and 13 integral with the rear end thereof. A transversely extending guide channel 14 is suitably secured to the base 11 and the sides of the channel slideably receive a traveling nut 15 (see FIGS. 2, 4 and 5 in particular) which is normally screw threaded over an intermediate screw threaded section 16 of a shaft 17. The latter has unthreaded end sections 18 and 20 at opposite ends of the threaded section, and is rotatably mounted in bearings formed in the side frames 12 and 13.

A reversible stepper motor 21 of conventional construction is suitably attached to the side frame 12 and is coupled to the shaft 17 to incrementally rotate the same in either of opposite directions under control of suitable control circuitry, not shown.

A transversely extending slot 22 is formed in the upper side of the nut 15 to pivotally receive a pin 23 secured to the rear end of a wire print head generally indicated at 24. The latter is of conventional construction comprising a relatively light, substantially triangular frame 25 having bearing means at its rear or printing end 26 to slideably support the printing ends of a series of small vertically aligned printing wires 27. Such wires are guided by the frame 25 for endwise movement and are attached at their foward ends to the armatures 28 of relatively heavy solenoids 30 attached to the frame 25. Flexible electrical conductors, partly shown at 31, are connected between the solenoids 30 and a suitable control circuitry (not shown) to energize the solenoids in different combinations as the rear end of the head sweeps across the print line to print desired character patterns. Although seven printing wires 27 and corresponding number of solenoids 30 are shown, nine or more wires and respective solenoids may also be employed.

The rear end 26 of the print head 24 is pivotally supported by the pin 23 which rests on the bottom of the slot 22 in nut 15, and a roller 32 which engages between the sides of channel 14, is rotatably mounted on pin 23 to guide the rear end 26 of the print head in a linear path along the plane of a thermo-sensitive paper strip 33 at the printing line.

The forward end of the print head 24 has a bracket 34 suitably secured to the underside thereof and pivotally mounted at 35 on a link 36 which, in turn, is pivoted on a fulcrum pin 37 attached to the base 11.

It will be noted that the link 36 extends at least substantially parallel to the axis of shaft 17 so as to guide the forward end of the print head 24 in a direction substantially at right angles to shaft 17 as the head pivots during its travel. Since the relatively heavy solenoids 31 are located adjacent the pivot point 35 and therefore bodily move through only a small distance, the inertia and momentum forces developed thereby at high printing speeds will be much less than if they were bodily transported the entire width of the character line to be printed.

Figure 3:
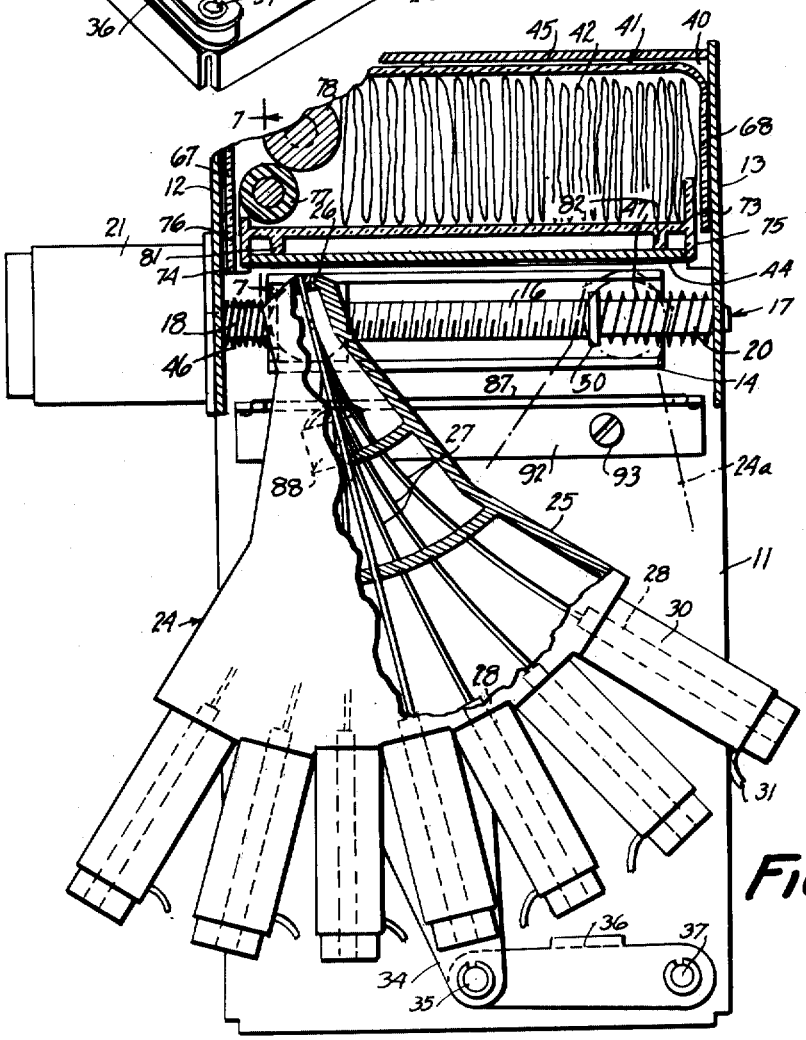
FIG. 3 is a top plan view, partly in section, of the printer.

A box-like compartment 40 is formed at the rear of the printer to receive a cassette 41 containing an inked printing ribbon 42 (FIGS. 1, 3, 4, 8 and 9). Such compartment comprises a base wall 43 and fore and aft walls 44 and 45, respectively. Walls 43 and 45 are suitably secured to the side frames 12 and 13 but the wall 44 is somewhat shorter, as seen in FIG. 3, and forms a printing platen against which the paper strip 33 rests during printing, the strip 33 passing between the platen wall 44 and a strand of the printing ribbon 42. Thus, the platen wall 44 defines the printing plane of the paper.

When the motor 21 is rotated, the rear end 26 of the print head 24 is transported between its full line position shown in FIG. 3, at one extreme of its travel, and its dot-dash line position 24a at the opposite extreme of its travel. During such movement, the print head 25 rocks about its pivot connection 35 while its rear end is constrained by roller 32 to move along the channel 14. Some slight fore and aft movement is also imparted to pivot 35. Although, due to the rocking of the head 24 about pivot 35, the rear printing tips of the wires 27 will move a slightly greater distance when the head 25 is at the extremes of its travel than when it is midway between such extremes, such difference in movement is relatively small and those print heads of which I am aware will permit such additional movement of the wires so that an even print will occur across the entire line of print.

Figure 2:
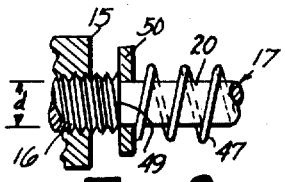
FIG. 2 is a fragmentary sectional view taken along the line 2—2 of FIG. 5.
Figure 5:
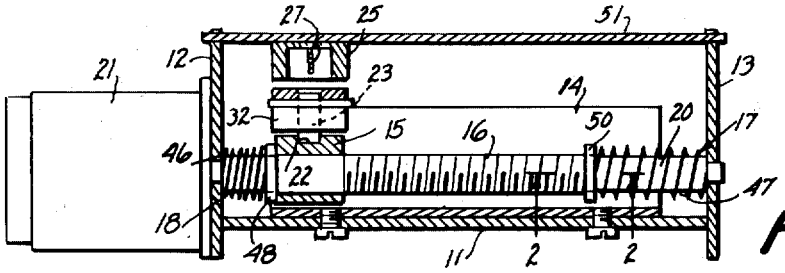
FIG. 5 is a transverse sectional view through the printer and is taken along the line 5—5 of FIG. 4.
Figure 6:
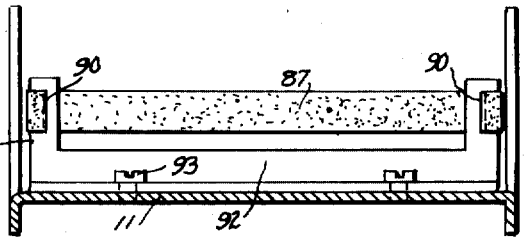
FIG. 6 is a transverse sectional view taken along the line 6—6 of FIG. 4, illustrating the support for the magnetic control tape.

As seen in FIGS. 2, 3 and 5 the unthreaded portions 18 and 20 of the shaft 17 each has a diameter equal to the root diameter "d" of the threaded portion 16. Compression springs 46 and 47 are fitted over the unthreaded shaft sections 18 and 20 and are compressed between the side frames 12, 13 and annular disks 48 and 50, respectively, which are slideable on the unthreaded shaft sections and normally engage the corresponding end shoulders 49 of the threaded section 16, as seen in FIG. 2.

When the head 25 approaches either end of its travel, the nut 15 strikes the adjacent disk 48 or 50, compressing the associated spring and moving onto the adjacent unthreaded shaft section 18 or 20. At the extreme end of its travel, the nut 15 moves completely off the threaded shaft section but is held against the shoulder 49 thereof by the compressed spring 46 or 47. Thus, any continued rotation of the shaft 17 in the same direction will not drive the head 24 further, but when the motor is reversed to drive the shaft 17 in the opposite direction, the compressed spring will return the nut 15 into threaded engagement with the threaded portion 16 to return the head in the opposite direction. Thus, vertical alignment of the printed characters in different print lines can be readily maintained.

A guide rail 51 (FIGS. 1, 4 and 5) is secured to the side frames 12 and 13 and slideably engages the upper surface of the print head 24 adjacent its rear end 26 to maintain the pivot pin 23 at the bottom of slot 22.

Figure 4:
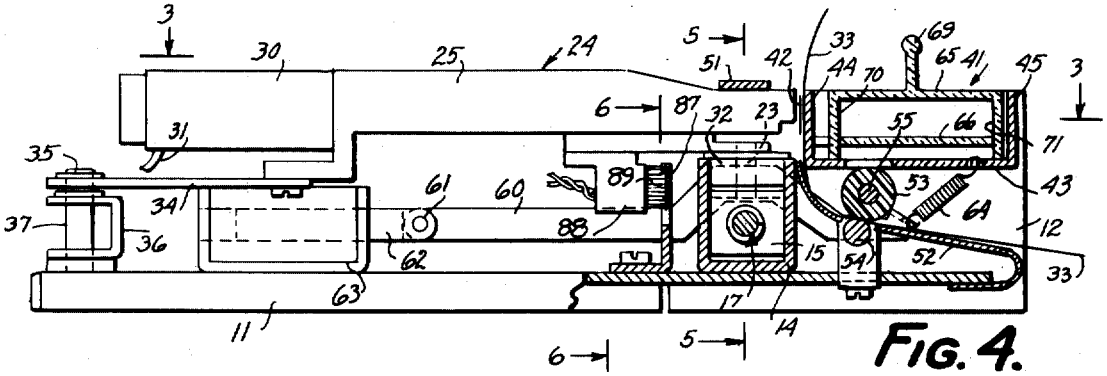
FIG. 4 is a side elevation view, partly in section.

Describing now the paper feeding mechanism, it will be noted in FIG. 4 that the paper strip 33 is fed from a suitable supply roll (not shown) and is guided over a guide member 52 and between a feed roll 53 of elastomeric material and a pressure roll 54, from whence it is guided upwardly over the platen wall 44. Feed roll 53 is carried by a shaft 55 (see also FIG. 7) which also carries a spur gear 56 and a ratchet 57. The latter is normally detented by a spring driven centralizer 58 and is incrementally rotated by a formed tooth 59 of a pawl 60 (see also FIG. 4) pivotally connected at 61 to the armature 62 of a solenoid 63 mounted on the base 11. A tension spring 64 normally holds the pawl 60 rearwardly and upwardly in engagement with a tooth of the ratchet 57. Upon application of a signal from the control circuitry to the solenoid 63, the pawl 60 will incrementally advance the ratchet 57 to advance the paper strip 33 from one print line position to the next.

Describing now the construction of the ribbon cassette 41, reference is had particularly to FIGS. 1, 3, 4, 7, 8 and 9 wherein it will be seen that the cassette is preferably formed of plastic and is enclosed by top and bottom walls 65, 66, side walls 67, 68 and front and rear walls 70 and 71. A handle 69 is mounted on the top wall 65 to enable the cassette to be readily lowered into the compartment 40 or to be removed therefrom.

Figure 7:
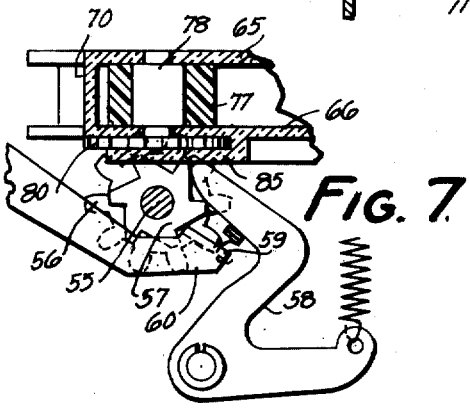
FIG. 7 is an enlarged fragmentary sectional view illustrating the drive means for the paper and ink printing ribbon and is taken along the line 7—7 of FIG. 3.
Figure 8:
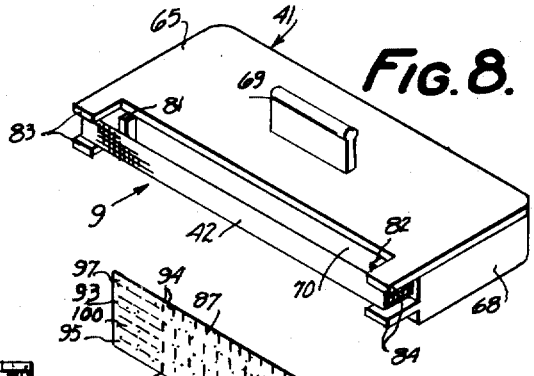
FIG. 8 is a perspective view of the printing ribbon cassette.
Figure 9:
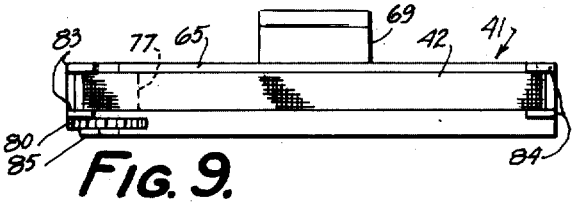
FIG. 9 is a front view of the ribbon cassette and is taken in the direction of the arrow 9 of FIG. 8.

The printing ribbon 42 is in an endless form and is bunched within the cassette. The ribbon exits through a slot 73 from whence it is guided around a first guide bracket 75 on the cassette wall 70, over the paper strip 33 and is then guided over a second guide bracket 74 on wall 70 and reenters through a second slot 76 where it is engaged between a feed roll 77 of elastomeric material and a pressure roll 78 within the cassette. As seen in FIG. 7, the feed roll 77 is mounted on a shaft 78 journalled in the top and bottom walls 65 and 66, respectively, of the cassette, and has a spur gear 80 secured thereto.

When the cassette 41 is mounted within the compartment 40, the gear 80 meshes at right angles with gear 56 to establish a drive between the paper feed shaft 55 and the ribbon whereby the ribbon is incrementally advanced each time the paper strip 33 itself is advanced.

In order to properly locate the cassette 41 within the compartment 40, locating tabs 81 and 82 are formed on the forward cassette wall 70 to engage behind the platen wall 44. The ribbon guiding brackets 74 and 75 engage the opposite ends of the platen wall 44 and thus locate the cassette in proper position endwise. Two sets of tabs 83 and 84 (FIG. 8) extend forwardly from the opposite ends of the cassette to cover the adjacent portions of the ribbon and thus protect the ribbon when handling the cassette out of the compartment 40. A second short bottom wall section 85 (FIG. 7) extends below the gear 80 to likewise protect the latter during handling of the cassette.

Means are provided to effect reversal of the motor 21 when the print head 24 reaches the extremes of its travel and to properly locate the dot patterns forming the printed characters, i.e. 86 (FIG. 1) across the paper strip 33. For this purpose, a strip 87 of magnetic tape, FIGS. 1, 3, 4, 6 and 10 is extended across the path of a multitrack magnetic read head 88 suitably attached to the underside of the print head 24. Such head is of conventional construction having four spaced track reading sections 89 thereon. The ends of the magnetic strip 87 are secured within slits 90 formed in arms 91 of a U-shaped bracket 92 which is secured by screws 93 to the base 11. The arms 91 are somewhat flexible and thus maintain the strip 87 under constant tension and in engagement with the read head 88.

Figure 10:
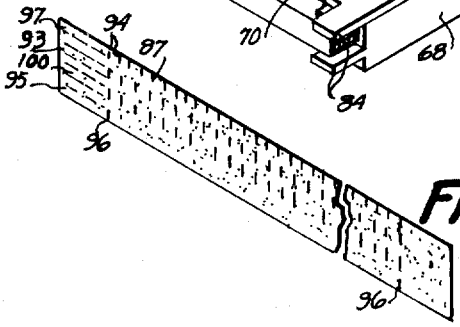
FIG. 10 is a perspective view of a section of the magnetic control tape.

As shown in FIG. 10, magnetic marks 94 are recorded in different tracks along the length of strip 87. For example, the lower track 95 contains two spaced marks 96 indicating the extremes of travel of the head 25. When one of such marks is sensed by the appropriate read section of the read head 88, the control circuitry for the motor 21 will be energized to reverse the direction of rotation of the latter. The upper track 97 contains a series of regularly spaced marks which, when the aligned read section 89 of the read head 88 is electrically selected, controls the timing of selected combinations of the print wires 27 to print and thus form the printed characters. This may form, for example, 12 characters per inch whereas the remaining tracks 98 and 100 contain marks which can control the spacing of the printed characters in different desired manners when the corresponding read head sections 89 are electrically selected. The bracket 92 carrying strip 87 may be readily replaced with other brackets carrying strips having different desired tracks or marks or the existing magnetic marks may be readily erased and recorded as desired by methods well known in the art.

I claim:

1. A printing device comprising means for supporting a record medium in a printing plane, a print head having printing means adjacent said printing plane, a rotatable screw shaft extending parallel to said printing plane, said shaft having a screw threaded section and an untreaded section, a nut connected to said head for moving said head along said printing plane, said nut being in threaded engagement with said threaded section of said shaft, spring means, said nut causing said spring means to flex upon movement of said nut onto said untreaded section upon rotation of said shaft in one direction, said spring being effective to return said nut into threaded engagement with said threaded section upon rotation of said shaft in the opposite direction, and means for rotating said shaft.

2. A printing device as defined in claim 1 wherein the diameter of said unthreaded section of said shaft is equal to the root diameter of said threaded section.

3. A printing device as defined in claim 1 wherein said spring means comprises a compression spring surrounding said unthreaded section.

4. A printing device as defined in claim 3 comprising an annular member slidable on said unthreaded section of said shaft, said annular member being normally held against said unthreaded section by said spring and being engageable by said nut whereby to flex said spring.

5. A printing device comprising means for supporting a record medium in a printing plane, a print head having printing means adjacent said printing plane, a rotatable screw shaft extending parallel to said plane, said shaft having a screw threaded section and unthreaded sections at opposite ends of said threaded section, a nut connected to said head for moving said head along said printing plane, said nut being threadable on said threaded section, a pair of spring devices, said nut causing one of said spring devices to flex upon movement of said nut in one direction from said threaded section onto one of said unthreaded sections upon rotation of said shaft in one direction and causing the other of said spring devices to flex upon movement of said nut in the opposite direction from said threaded section onto the other of said unthreaded sections upon rotation of said shaft in the opposite direction, said one spring device being effective to return said nut into threaded engagement with said threaded section upon rotation of said shaft in said opposite direction and said other spring device being effective to return said nut into threaded engagement with said threaded section upon rotation of said shaft in said one direction, and means for rotating said shaft.

6. A printing device as defined in claim 5 wherein said spring device comprise compression springs fitted over respective ones of said unthreaded section, and annular members slidable over said unthreaded sections, said spring devices being effective to normally yieldably hold said annular members against the respective ends of said threaded section.

7. A printing device of the dot matrix type including means for supporting a record medium in a printing plane, a print head having one end adjacent said printing plane, and a plurality of elongate printing elements carried by said head and selectively movable endwise relative to said head to imprint on said record medium, comprising first guide means adjacent said one end of said head for pivotally guiding said one end of said head in a direction parallel to said plane, second guide means adjacent the opposite end of said head for pivotally guiding said opposite end in a direction at least substantially at right angles to said plane, a rotatable screw shaft extending parallel to said plane, said shaft having a screw threaded section and an unthreaded section, a nut, means pivotally connecting said nut to said head, the nut being in threaded engagement with said threaded section of said shaft, spring means, said nut causing said spring means to flex upon movement of said nut onto said unthreaded section upon rotation of said shaft in one direction, said spring means being effective to return said nut into threaded engagement with said threaded section upon rotation of said shaft in the opposite direction, and means for rotating said shaft.

8. A printing device as defined in claim 7 wherein said first guide means comprises a U-shaped channel member, said screw shaft extending between the sides of said member, pivot means connected to said head, said pivot means being guided by said sides of said member for movement along said member, and said nut slidably engaging said sides of said member whereby to prevent turning of said nut during movement of said nut along said shaft.

* * * * *